US009269513B2

(12) United States Patent
Aarskog

(10) Patent No.: US 9,269,513 B2
(45) Date of Patent: Feb. 23, 2016

(54) CONTACTOR ARRANGEMENT FOR USE IN DIELECTRIC LIQUID

(71) Applicant: Siemens Aktiengesellschaft, Munich (DE)

(72) Inventor: Fredrik Gundersen Aarskog, Trondheim (NO)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 12 days.

(21) Appl. No.: 13/926,023

(22) Filed: Jun. 25, 2013

(65) Prior Publication Data

US 2013/0342294 A1 Dec. 26, 2013

(30) Foreign Application Priority Data

Jun. 25, 2012 (EP) ..... 12173434

(51) Int. Cl.

| | |
|---|---|
| ***H01H 75/00*** | (2006.01) |
| ***H01H 53/00*** | (2006.01) |
| ***H01H 33/10*** | (2006.01) |
| ***H01H 1/54*** | (2006.01) |
| ***H01H 53/02*** | (2006.01) |
| ***H01H 50/04*** | (2006.01) |
| ***H01H 51/29*** | (2006.01) |

(52) U.S. Cl.

CPC ..... *H01H 33/10* (2013.01); *H01H 1/54* (2013.01); *H01H 50/045* (2013.01); *H01H 51/29* (2013.01); *H01H 53/02* (2013.01)

(58) Field of Classification Search

USPC ..... 335/16, 147

See application file for complete search history.

(56) References Cited

U.S. PATENT DOCUMENTS

| | | | | |
|---|---|---|---|---|
| 3,906,413 | A * | 9/1975 | Clausing | 335/41 |
| 4,454,490 | A * | 6/1984 | Belbel et al. | 335/16 |
| 4,467,301 | A * | 8/1984 | Goodrich | 335/195 |
| 4,616,202 | A * | 10/1986 | Kakizoe | 335/133 |
| 5,430,420 | A * | 7/1995 | Maier | 335/16 |
| 5,663,699 | A * | 9/1997 | Shiroyama | 335/126 |
| 5,878,704 | A * | 3/1999 | Schebitz et al. | 123/90.11 |
| 5,912,604 | A * | 6/1999 | Harvey et al. | 335/9 |
| 8,461,947 | B2 * | 6/2013 | Wendel et al. | 335/14 |
| 8,698,582 | B2 * | 4/2014 | Uchida | 335/147 |
| 2005/0116799 | A1 * | 6/2005 | Ostergaard | 335/132 |
| 2013/0021122 | A1 * | 1/2013 | Uchida | 335/131 |

FOREIGN PATENT DOCUMENTS

| | | | |
|---|---|---|---|
| GB | 2420018 A | 5/2006 | H01H 33/00 |
| WO | 03/081728 A1 | 10/2003 | H01R 13/523 |
| WO | 2008/004084 A1 | 1/2008 | E21B 41/00 |

OTHER PUBLICATIONS

European Search Report, Application No. 12173434.7, 5 pages, Nov. 26, 2012.

* cited by examiner

*Primary Examiner* — Alexander Talpalatski

(74) *Attorney, Agent, or Firm* — Slayden Grubert Beard PLLC

(57) ABSTRACT

A contactor arrangement for operation in a dielectric liquid environment may include a first connection terminal and a second connection terminal, a contactor having a fixed contact, and a movable contact that is movable relative to the fixed contact, the contactor having an open state in which the movable contact is spaced apart from the fixed contact and a closed state in which the movable contact is in contact with the fixed contact so as to provide an electric connection through the contactor via the movable contact. The contactor arrangement may further include a conductor section.

20 Claims, 3 Drawing Sheets

CONTACTOR ARRANGEMENT FOR USE IN DIELECTRIC LIQUID

CROSS-REFERENCE TO RELATED APPLICATIONS

This application claims priority to EP Patent Application No. 12173434.7 filed Jun. 25, 2012. The contents of which is incorporated herein by reference in its entirety.

TECHNICAL FIELD

This disclosure relates to a contactor arrangement for operation in a dielectric liquid environment and to a subsea electric device, e.g., a subsea variable speed drive, comprising such contactor arrangement.

BACKGROUND

Contactors are devices which can be used for switching power circuits. They can generally handle loads drawing high currents. As such, they may for example be used to control or switch electric motors, electric drives and the like.

Contactors are different to circuit breakers in that they are not intended to interrupt short circuit currents, as the contact regions may otherwise suffer severe damage due to arcing. Arcing can also occur when switching at nominal currents. To reduce arcing, the contacts of the contactor can be placed under vacuum or in an inert gas.

To avoid the detrimental effects of arcing when short circuit currents occur, the contactor can be maintained in a closed position. This is particularly true for subsea applications. In such application, the contactor may for example be placed in a pressurized enclosure, such as a subsea canister, which is filled with dielectric liquid that is balanced to the outside pressure. Arcing can lead to a combustion and extensive contamination of the dielectric liquid. Accordingly, it is desirable to keep the contactor closed to prevent arcing.

Conventional contactors are generally not suitable for such operation. If the contactor remains closed, there will be excessively high currents in the contacts. These currents will result in a blow-off force or Slade force which acts on the contacts in a direction that separates the closed contacts and reduces the contact force/pressure. This reduction leads to a degradation of the electrical contact and to an increase in resistance. Due to the high short circuit current through the contact, the increased resistance leads to excessive heating and as a consequence to the welding of the contacts. The contacts can thus not be opened any more, rendering the contactor inoperable. This is particularly problematic for subsea applications, since removal of the contactor from the sea floor and its replacement are technically challenging and very cost intensive tasks.

It is thus desirable to provide a contactor which can remain in a closed state even in the presence of a short circuit current without suffering severe damage and which is still operable after clearance of the fault.

SUMMARY

One embodiment provides a contactor arrangement for operation in a dielectric liquid environment, the contactor arrangement having a first connection terminal and a second connection terminal, the contactor arrangement comprising: a contactor having a fixed contact and a movable contact that is movable relative to the fixed contact, the contactor having an open state in which the movable contact is spaced apart from the fixed contact and a closed state in which the movable contact is in contact with the fixed contact so as to provide an electric connection through the contactor via the movable contact, and a conductor section which is connected in series with the contactor between the first connection terminal and the second connection terminal, the conductor section and the fixed contact being arranged on opposite sides of the movable contact, the conductor section extending along the movable contact in the direction of current flow through the movable contact, the arrangement being such that a current between the first and second connection terminals via the movable contact and the conductor section results in an electromagnetic force being exerted on the movable contact.

In a further embodiment, the conductor section is connected and arranged in such way that in operation in the closed state, the current through the conductor section has a direction that is substantially opposite to the direction of the current through the movable contact, so that a repelling force is generated between the movable contact and the conductor section, the arrangement being such that the repelling force increases the contact pressure between the movable contact and the fixed contact.

In a further embodiment, the conductor section is connected and arranged in such way that in operation in the closed state, the current through the conductor section has a direction that is substantially parallel to the direction of the current through the movable contact, so that an attractive force is generated between the movable contact and the conductor section, the arrangement being such that the attractive force acts on the movable contact to move the movable contact towards the open state.

In a further embodiment, the fixed contact comprises a first fixed contact and a second fixed contact each having a contact portion for contacting a respective contact portion on the movable contact in the closed state, the first fixed contact being connected to the first connection terminal, the second fixed contact being connected to the conductor section.

In a further embodiment, the movable contact comprises at least one contact plate extending in the direction of current flow through the movable contact, the contact plate having contact portions at each end thereof, the contact portions facing respective contact portions on the fixed contact.

In a further embodiment, the conductor section is a metal bar or a metal plate, preferably a copper bar.

In a further embodiment, one end of the conductor section is electrically connected to the second connection terminal or forms the second connections terminal, and wherein the other end of the conductor section is connected to the fixed contact of the contactor, said connection being provided by a U-shaped or C-shaped conductor section, preferably by a correspondingly shaped metal bar.

In a further embodiment, the conductor section is a bus bar section.

In a further embodiment, the contactor arrangement further comprises one or more fixing elements adapted and arranged so as to fix the position of the conductor section relative to the fixed contact.

In a further embodiment, the fixing elements comprise isolating spacer elements and bolts affixed to the isolating spacer elements, the fixing elements being arranged between the conductor section and the fixed contact and being mechanically mounted thereto by means of the bolts.

In a further embodiment, the first connection terminal and the second connection terminal of the contactor arrangement are connected to an input conductor or to a bus bar of a subsea device.

In a further embodiment, in the open state of the contactor, the spacing between the movable contact and the conductor section is smaller than the thickness of the movable contact.

In a further embodiment, the contactor arrangement further comprises a subsea enclosure which is filled with a dielectric liquid, the contactor arrangement being located in the subsea enclosure in the dielectric liquid.

Another embodiment provides a subsea electric device comprising any of the contactor arrangements disclosed above.

In another embodiment, the subsea electric device has an input conductor connected to a power source, wherein the contactor arrangement is connected to the input conductor to enable the disconnection of the subsea electric device from the power source.

BRIEF DESCRIPTION OF THE DRAWINGS

Example embodiments are discussed below in detail with reference to the drawings, in which.

DETAILED DESCRIPTION

Figure 1:
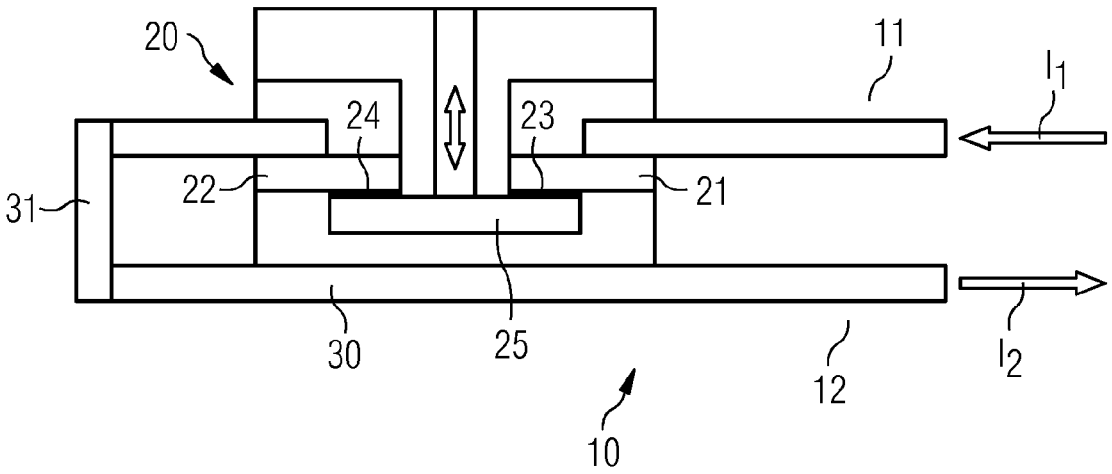
FIG. 1 is a schematic diagram showing an example contactor arrangement according to an example embodiment of the invention.

Accordingly, there is a need for an improved contactor, e.g., a contactor that is suitable for subsea use.

One embodiment provides a contactor arrangement for operation in a dielectric liquid environment. The contactor arrangement has a first connection terminal and a second connection terminal. The contactor arrangement comprises a contactor and a conductor section. The contactor has a fixed contact and a movable contact that is movable relative to the fixed contact. The contactor has an open state in which the movable contact is spaced apart from the fixed contact and a closed state in which the movable contact is in contact with the fixed contact so as to provide an electric connection through the contactor via the movable contact. The conductor section is connected in series with the contactor between the first connection terminal and the second connection terminal. The conductor section and the fixed contact are arranged on opposite sides of the movable contact. The conductor section extends along the movable contact in the direction of current flow through the movable contact (i.e. when the contactor is operated in the closed state). The arrangement is such that a current between the first and second connection terminals via the movable contact and the conductor section results in an electromagnetic force being exerted on the movable contact. The exerted force can result from the current in the conductor section, in particular from a repulsion of the conductor section and the movable contact due to the electric currents.

By such arrangement, a force can be applied to the movable contact which depends on the magnitude of the electric current flowing through the contactor arrangement. The configuration may be such that the force pushes the movable contact into firm contact with the fixed contact, thereby reducing the effect of the blow-off force. In particular, when a short circuit current is present in the contactor arrangement, the force that is due to the conductor element will increase and act in a direction opposite to the direction of the blow-off force, so that the fixed and movable contacts remain in firm contact and so that the increase in resistance through the contactor can be reduced. Melting of the contacts can thus be prevented. The contactor arrangement can thus be operated in the closed state during short circuit conditions without losing functionality, i.e. the contactor remains operational. Since no significant arcing occurs, the contactor arrangement is suitable for operation in a dielectric liquid environment, for example in a pressure compensated subsea canister filled with dielectric liquid.

According to an embodiment, the conductor section is connected and arranged in such way that in operation in the closed state, the current through the conductor section has a direction that is substantially opposite to the direction of the current through the movable contact, so that a repelling force is generated between the movable contact and the conductor section. The arrangement is such that the repelling force increases the contact pressure between the movable contact and the fixed contact. Such arrangement achieves an increase of the contact force between the fixed contact and the movable contact in dependence on the magnitude of electric current through the conductor arrangement. Accordingly, short circuit conditions will lead to an increased contact force, and an increase in resistance through the contacts can be reduced or even avoided, thereby preventing excessive heating and melting of the contacts. The contactor can thus still be opened after a short circuit occurred.

In an embodiment, the conductor section is connected and arranged in such way that in operation in the closed state, the current through the conductor section has a direction that is substantially parallel to the direction of the current through the movable contact, so that an attractive force is generated between the movable contact and the conductor section, the arrangement being such that the attractive force acts on the movable contact to move the movable contact towards the open state. Such arrangement allows the contactor to be opened very quickly, since the current through the conductor section provides an additional opening force. Arcing can thus be reduced when opening the contactor. Such configuration is particularly useful in applications in which the contactor needs to be opened very quickly, e.g. upon occurrence of a fault, while arcing is to be maintained at a minimum.

In an embodiment, the fixed contact may comprise a first and a second fixed contact each having a contact portion for contacting a respective contact portion on the movable contact in the closed state, the first fixed contact being connected to the first connection terminal, the second fixed contact being connected to the conductor section. The contact portion may for example be provided in form of a contact pad, e.g. as a circular protrusion on the respective contact. A well defined contact area with increased contact pressure (e.g. pad pressure) may thus be achieved. The first and second fixed contacts may be provided by metal plates, which may have protruding circular portions for forming a contact portion or contact pad.

The movable contact may comprise at least one contact plate extending in the direction of current flow through the movable contact, the contact plate having contact portions at each end thereof, the contact portions facing respective contact portions on the fixed contact. Again, the contact portions may be provided by contact pads, in particular by circular protrusions. One, two, three or more movable contacts may be provided (connected in parallel). Similarly, the fixed contact (or both fixed contacts) may be provided in form of one, two, three or more fixed contact plates.

The conductor section may be a metal bar or a metal plate. It may for example be a copper bar. The conductor section can for example be a bus bar section.

One end of the conductor section may be electrically connected to the second connection terminal or may form the second connections terminal. The other end of the conductor section may be connected to the fixed contact of the contactor. In an embodiment, the connection may be provided by a U-shaped or C-shaped conductor section, for example by a correspondingly shaped metal bar. The connection may for example be provided by bus bar segments put together to form a U-shape or a C-shape or a single bus bar segment may be formed into such shape. It should be clear that the U-shaped or C-shaped connection and the conductor section may be formed of a single piece, e.g. of a single copper bar or bus bar segment.

In an embodiment, the conductor section is a bus bar section.

The contactor arrangement may further comprise one or more fixing elements adapted and arranged so as to fix the position of the conductor section relative to the fixed contact. It may thus be ensured that the conductor section does not move relative to the fixed contacts, for example by increasing the distance to the movable contact when a repelling force acts between the movable contact and the conductor section. A constant application of the force to the movable contact can thus be ensured.

The fixing elements may comprise isolating spacer elements and bolts affixed to the isolating spacer elements. The fixing elements may be arranged between the conductor section and the fixed contact and may be mechanically mounted thereto by means of the bolts. There may for example be through holes provided in the one or two fixed contacts and in the conductor section through which the bolts reach. The bolts can be threaded bolts and can be affixed by corresponding nuts.

The first connection terminal and the second connection terminal of the contactor arrangement may be connected or mounted to an input conductor or to bus bars of a subsea device. The bus bars may for example provide part of an input conductor of an electric subsea device. This allows the switching of relatively high currents.

The main operating current flow may for example be via first terminal through the contactor and the conductor section and via the second terminal (or in reverse direction).

The contactor arrangement may be adapted to operate at a nominal operating current of more than 100 A, preferably more than 250 A or even more than 500 A. The contactor arrangement may be adapted for an operating voltage of more than 500 V, e.g. for 690 V, or for an operation in the medium or even high voltage range. The operating voltage may for example lie within the range of about 500V to about 50,000 V.

The conductor section may have a width of at least 50 mm, e.g. a width in a range of about 50 mm to about 100 mm. It may have a thickness of at least 2.5 mm, preferably at least 5 mm, it may for example have a thickness in a range between about 2.5 mm and about 30 mm.

The spacing between the movable contact and the conductor section may, in the open state of the contactor, be smaller than the thickness of the movable contact.

The movable contact may for example have a thickness of more than 2.5 mm or even more than 5 mm, it may for example have a thickness in a range between about 2.5 mm and about 30 mm.

Note that these are only examples, and that the actual dimensions will be determined in dependence on the particular application and operating voltages/currents.

In an embodiment, the contactor arrangement may further comprise a subsea enclosure which is filled with a dielectric liquid, the conductor arrangement being located in the subsea enclosure in the dielectric liquid. Since the contactor arrangement can be used in dielectric liquid and since subsea enclosure can be pressure balanced to the outside pressure due to the dielectric liquid, a more compact enclosure can be achieved since its interior does not need to be maintained at close to atmospheric pressure.

A further embodiment provides a subsea electric device comprising a contactor arrangement in any of the above described configurations. The subsea electric device can be provided with a compact and relatively lightweight pressure compensated (pressure balanced) enclosure, since the contactor arrangement can be operated in dielectric liquid which enables the pressure balancing. Pressure balanced or pressure compensated means that the enclosure is provided with a pressure compensator which balances or equalizes the pressure inside the enclosure to the ambient pressure, e.g. to the pressure existing at the installation depth of the subsea device.

Even if a short circuit should occur, resulting in short circuit currents through the contactor arrangement, the contactor arrangement can be closed, so that a pollution of the dielectric liquid due to arcing can be prevented. Due to the configuration of the contactor arrangement, the contacts may not melt and the contactor remains operational. Reliability of the electrical subsea electric device can thus be improved. Such short circuit may be cleared by another device of the subsea installation, e.g. by means of a circuit breaker of a subsea switchgear. The subsea electric device may for example be a variable speed drive.

In an embodiment, the subsea electric device has an input conductor connected to a power source, wherein the contactor arrangement is connected to the input conductor so as to enable the disconnection of the subsea electric device from the power source.

The features of the embodiments of the invention mentioned above and yet to be explained below can be combined with each other unless noted to the contrary.

In the following, embodiments of the invention will be described in detail with reference to the accompanying drawings. It is to be understood that the following description of the embodiments is given only for the purpose of illustration and is not to be taken in a limiting sense.

It should further be noted that the drawings are to be regarded as being schematic representations only, and elements in the drawings are not necessarily to scale with each other. Rather, the representation of the various elements is chosen such that their function and general purpose become apparent to a person skilled in the art.

FIG. 1 is a schematic drawing which shows a sectional side view of a contactor arrangement 10 according to an example embodiment of the invention. The contactor arrangement 10 comprises a contactor 20. The contactor 20 comprises two fixed contacts 21, 22 and a movable contact 25.

The contactor arrangement has a first connection terminal 11 and a second connection terminal 12. In the embodiment of FIG. 1, the first connection terminal 11 is connected to the first fixed contact 21 via a conductor segment, which can for example be a metal bar, e.g. a piece of a bus bar. The fixed contact 21 can also directly provide the first connection terminal 11. The second connection terminal 12 is connected to the second fixed contact 22 via a conductor section 30.

The movable contact 25 has contact portions 23, 24 which face respective contact portions on the fixed contacts 21, 22. The movable element is movable with respect to the fixed contacts 21, 22 between an open position and a closed position, as indicated by the double arrow. In the closed position, which is illustrated in FIG. 1, the respective contact portions are in contact with each other, thus closing the circuit between the first and second connection terminals 11, 12. To open the contactor, the movable contact 25 is moved towards the conductor section 30. The respective contact portions thus lose contact and are spaced apart, thereby opening the electric connection between the first and second connection terminals 21, 22. The movement can be effected by an actuator, e.g. by a magnetic actuator including a coil wound around a rod connected to the movable contact 25, which actuator can be controlled by a current much lower than the operating current of the contactor.

It should be clear that in other embodiments, the contactor may be configured differently, e.g. with only one fixed contact, wherein one end of the movable contact 25 is directly connected to terminal 11 or the like.

The movable contact 25 can be a metal plate having an extension in the direction of current flow through the movable contact, i.e. along the arrow $I_1$. In the example of FIG. 1, this 'longitudinal' extension is such that both fixed contacts 21, 22 are bridged.

The conductor section 30 extends along the direction of the above mentioned current flow through movable contact 25. In the example of FIG. 1, the current flow through the movable contact 25 is essentially parallel to the longitudinal extension of the movable contact 25 and to the extension of the conductor section 30. The movable contact 25 and conductor section 30 run substantially parallel over the length of the movable contact 25. Not that the width of the movable contact (the extension perpendicular to the image plane) can be smaller or larger than its longitudinal extension.

The conductor section 30 is connected to the second fixed contact 22 of the contactor 20 by the C-shaped or U-shaped conductor section 31. In the example of FIG. 1, this conductor section is indicated as being made from different segments of conductor, e.g. from plural bus bar segments. It should be clear that in other configurations, this conductor section 31 may be made out of a single piece of conductor (see FIG. 3) or may even be made out of a single piece with the conductor section 30.

In operation in the closed state of the contactor 20, the current now flows through the movable contact 25 in the direction indicated by arrow $I_1$ and flows through the conductor section 30 in a direction indicated by arrow $I_2$. The currents are thus in opposite direction (note that the current directions may be reversed, e.g. when operating with AC currents or with DC in reverse direction).

In case of a short circuit current, the contact portions 23, 24 will experience a separating force trying to separate the movable contact 25 from the fixed contacts 21, 22 (so called blow-off force or Slade force). This force can be expressed by $$F_{pad}=8*10^{-5}*I^{1.54}$$

wherein I is the current through the contact portion, e.g. through a contact pad, and wherein $F_{pad}$ is the force experienced by the contact portion, e.g. the contact pad.

In the example of FIG. 1, this force acts downward to separate the movable contact 25 from the fixed contacts 21, 22. The configuration of FIG. 1 now provides a counteracting force which pushes the movable contact 25 towards the fixed contacts 21, 22. The generation of this additional upward force is illustrated in FIG. 2.

Figure 2:
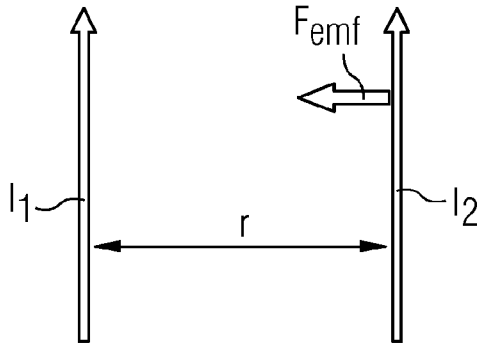
FIG. 2 is a schematic diagram illustrating forces acting on two current carrying conductors.

FIG. 2 shows two parallel currents in two different parallel conductors. The moving charge creates an electromagnetic field. Due to the interaction of the two electromagnetic fields generated by the currents $I_1$ and $I_2$ which are present in the respective conductors, an attractive electromagnetic force $F_{emf}$ results, which attracts the conductors towards each other. Similarly, if the currents are in opposite direction (i.e. $I_1$ or $I_2$ is reversed), a force in opposite direction will be generated so that the two conductors repel each other. The force depends in the currents $I_1$ and $I_2$ and the distance r between the corresponding conductors. The force is given by $$F = \frac{\mu_0 I_1 I_2 L}{2\pi r}$$

wherein L denotes the length of the conductors (along which the currents run in parallel/anti-parallel), and wherein $\mu_0$ is the permeability of free space.

Now returning to FIG. 1, it can be seen that the movable contact 25 and the conductor section 30 are parallel, the currents being in opposite directions. The length L would substantially correspond to the distance between the contact portions 23, 24 where the current enters and leaves the movable contact 25. Since the currents are in opposite direction, as explained above, a repelling force will be generated in operation which will act to separate the movable contact 25 and the conductor section 30. The movable contact will thus be pushed against the fixed contacts 21, 22, thereby increasing the contact pressure. The force is dependent on the magnitude of the currents $I_1$ and $I_2$. As can be seen from the above equation, if there is a high current, e.g. a short circuit current through the contactor arrangement, the electromagnetic force will increase substantially. The blow-off force will thus be compensated, and the contact pressure will be increased.

For further increasing the force acting on the movable component, the distance r can be made smaller, e.g. by reducing the distance between the movable component 25 and the conductor section 30. It can be reduced to the extent that only a small gap exists between the movable contact 25 and the conductor section 30 in the open state of the contactor, e.g. a gap having less than 50% of the thickness of the movable contact 25 (see FIG. 4). Isolating element may be provided in such gap between the movable contact 25 and the conductor section 30.

Figure 3:
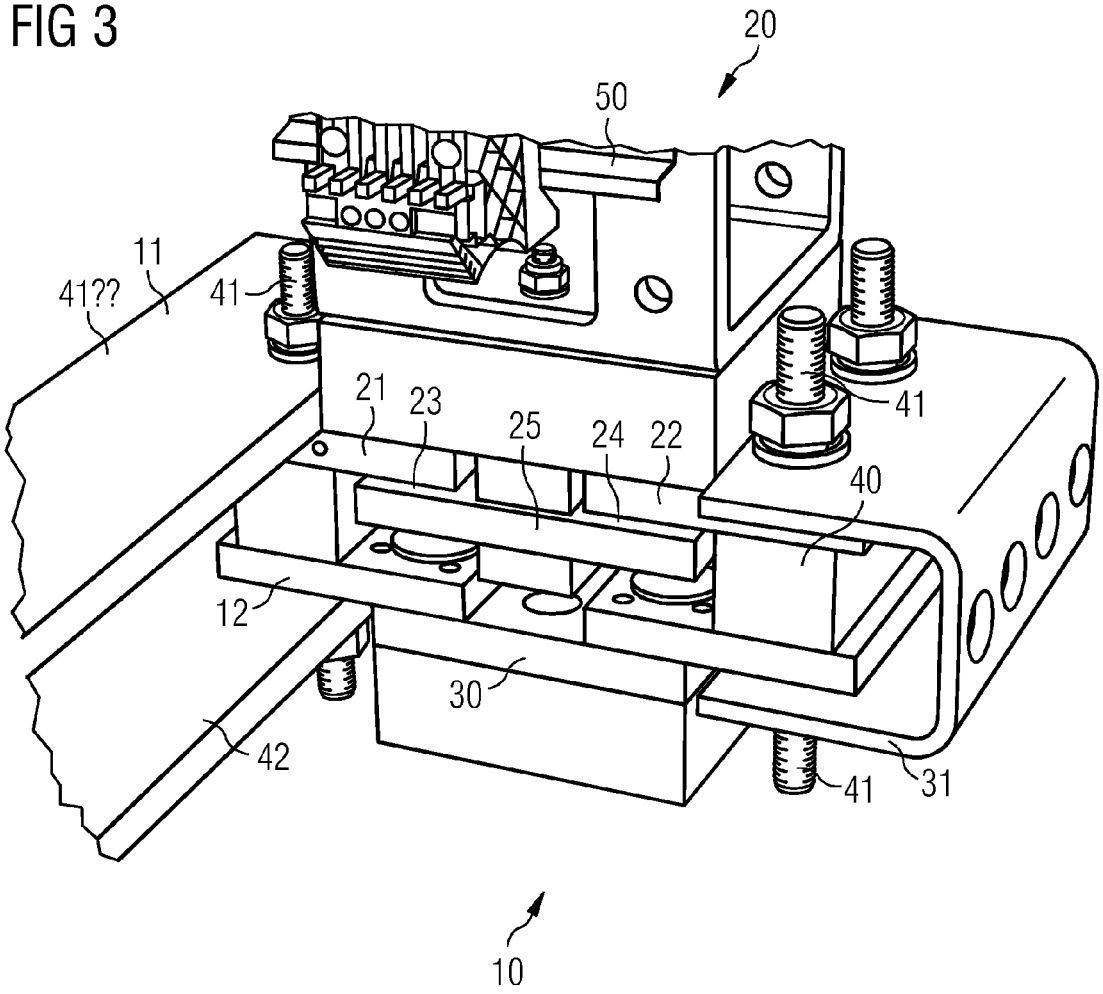
FIG. 3 shows an example contactor arrangement according to one embodiment of the invention.

FIG. 3 shows a particular implementation of the contactor arrangement 10. In the example of FIG. 3, the conductor section 30 is mounted to two contact plates. The U-shaped conductor section 31 is provided by a correspondingly shaped busbar segment. The contactor arrangement 10 further comprises a fixing element in form of isolating spacer elements 40 and threaded bolts 41. The bolts are used to mount and secure the U-shaped conductor section 31. Terminals 11 and 12 are connected to respective busbars 41 and 42, again by threaded bolts. Other types of connection are certainly also conceivable. The conductor section 30 is a metal plate, in particular a copper plate. Reference numeral 50 designates an actuator assembly adapted to move the movable contact 25, in particular to bring it from a closed position in which it provides an electric connection between fixed contacts 21 and 22 to an open position in which it is spaced apart from these fixed contacts.

Figure 4:
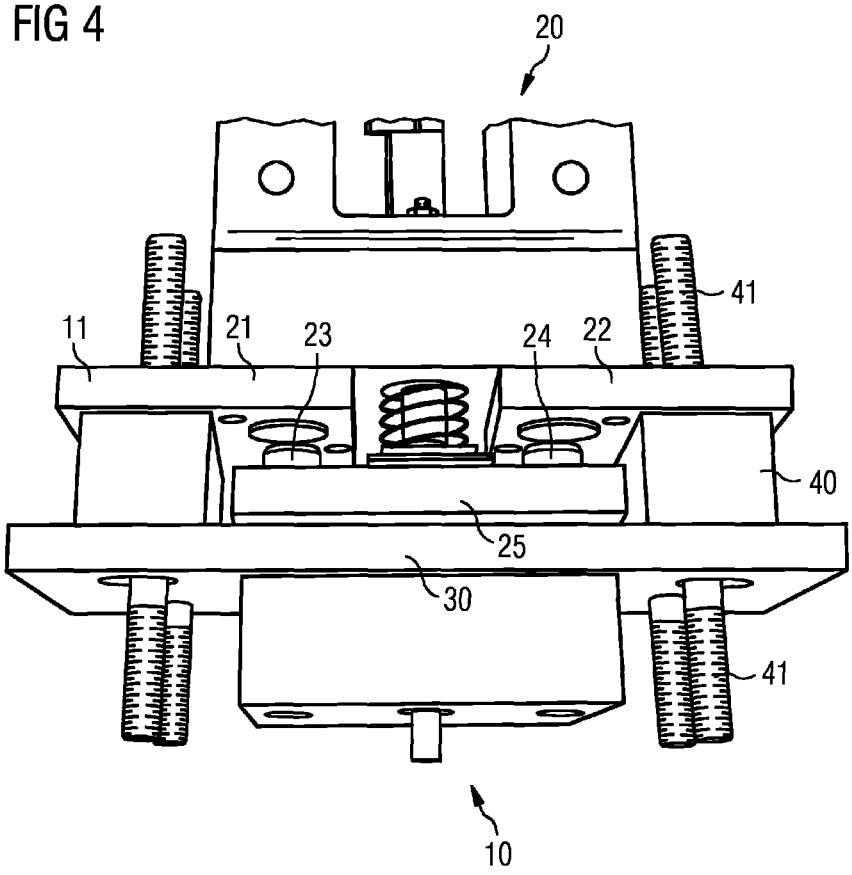
FIG. 4 shows a further example contactor arrangement according to another embodiment of the invention.

FIG. 4 shows a further possible implementation of the contactor arrangement 10. The U-shaped conductor segment 31 is not shown in FIG. 4. In contrast to FIG. 3, a single busbar segment is now present which provides the conductor section 30. This way, the distance r to the movable contact 25 can be reduced. The movable contact 25 is in the 'open' position in the example of FIG. 4. The contact pads on the fixed contacts 21 and 22 are visible.

By electrically connecting the fixed contact 22 to the left hand end of the conductor section 30 and by providing the second connection terminal on the right hand end of the conductor section 30, it can be achieved that the currents in the movable contact 25 and in the conductor section 30 are parallel. This would lead to an attractive force in operation, which would allow the movable contact 25 to be opened faster, due to the additional 'downward' force.

Features of the above outlined embodiments can be combined with each other. The skilled person will appreciate that the above described embodiments are only examples given for the purpose of illustration, and that modifications may be made without departing from the scope of the invention.

What is claimed is:

1. A contactor arrangement for operation in a dielectric liquid environment, the contactor arrangement comprising:

a first connection terminal, a second connection terminal, a contactor having a fixed contact and a movable contact movable relative to the fixed contact along a movement axis, the contactor configured to switch between:

an open state in which the movable contact is spaced apart from the fixed contact and a closed state in which the movable contact is in contact with the fixed contact so as to provide an electric connection through the contactor via the movable contact, a conductor section connected in series with the contactor between the first connection terminal and the second connection terminal, wherein the conductor section and the fixed contact are arranged on opposite sides of the movable contact, the conductor section extending along the movable contact in the direction of current flow through the movable contact, the arrangement being such that a current between the first and second connection terminals via the movable contact and the conductor section results in an electromagnetic force being exerted on the movable contact, wherein the conductor section and contactor are arranged such that in the open state of the contactor, the movable contact is spaced apart from the conductor section by a gap having a width along the movement axis of the movable contact that is less than 50% of a thickness of the movable contact along the movement axis, and at least one isolation element arranged in the gap between the movable contact and the conductor section.

2. The contactor arrangement according to claim 1, wherein the conductor section is connected and arranged such that in operation in the closed state, the current through the conductor section has a direction that is substantially opposite to the direction of the current through the movable contact, such that a repelling force is generated between the movable contact and the conductor section, wherein the repelling force increases the contact pressure between the movable contact and the fixed contact.

3. The contactor arrangement according to claim 1, wherein the conductor section is connected and arranged such that in operation in the closed state, the current through the conductor section has a direction that is substantially parallel to the direction of the current through the movable contact, such that an attractive force is generated between the movable contact and the conductor section, wherein the attractive force acts on the movable contact to move the movable contact towards the open state.

4. The contactor arrangement according to claim 1, wherein the fixed contact comprises a first fixed contact and a second fixed contact, each having a contact portion for contacting a respective contact portion on the movable contact in the closed state, the first fixed contact being connected to the first connection terminal, and the second fixed contact being connected to the conductor section.

5. The contactor arrangement according to claim 1, wherein the movable contact comprises at least one contact plate extending in the direction of current flow through the movable contact, the contact plate having contact portions at each end thereof, and the contact portions facing respective contact portions on the fixed contact.

6. The contactor arrangement according to claim 1, wherein the conductor section is a metal bar or a metal plate.

7. The contactor arrangement according to claim 1, wherein one end of the conductor section is electrically connected to the second connection terminal or forms the second connections terminal, and wherein the other end of the conductor section is connected to the fixed contact of the contactor, said connection being provided by a U-shaped or C-shaped conductor section.

8. The contactor arrangement according to claim 1, wherein the conductor section is a bus bar section.

9. The contactor arrangement according to claim 1, further comprising one or more fixing elements configured to fix the position of the conductor section relative to the fixed contact.

10. The contactor arrangement according to claim 9, wherein the fixing elements comprise isolating spacer elements and bolts affixed to the isolating spacer elements, the fixing elements being arranged between the conductor section and the fixed contact and being mechanically mounted thereto by the bolts.

11. The contactor arrangement according to claim 1, wherein the first connection terminal and the second connection terminal of the contactor arrangement are connected to an input conductor or to a bus bar of a subsea device.

12. The contactor arrangement according to claim 1, wherein in the open state of the contactor, the spacing between the movable contact and the conductor section is smaller than the thickness of the movable contact.

13. The contactor arrangement according to claim 1, further comprising a subsea enclosure filled with a dielectric liquid, wherein the contactor arrangement is located in the subsea enclosure in the dielectric liquid.

14. A subsea electric device comprising:

a contactor arrangement comprising:

a first connection terminal, a second connection terminal, a contactor having a fixed contact and a movable contact movable relative to the fixed contact along a movement axis, the contactor configured to switch between:

an open state in which the movable contact is spaced apart from the fixed contact and a closed state in which the movable contact is in contact with the fixed contact so as to provide an electric connection through the contactor via the movable contact, a conductor section connected in series with the contactor between the first connection terminal and the second connection terminal, wherein the conductor section and the fixed contact are arranged on opposite sides of the movable contact, the conductor section extending along the movable contact in the direction of current flow through the movable contact, the arrangement being such that a current between the first and second connection terminals via the movable contact and the conductor section results in an electromagnetic force being exerted on the movable contact, wherein the conductor section and contactor are arranged such that in the open state of the contactor, the movable contact is spaced apart from the conductor section by a gap having a width along the movement axis of the movable contact that is less than 50% of a thickness of the movable contact along the movement axis, and at least one isolation element arranged in the gap between the movable contact and the conductor section.

15. The subsea electric device according to claim 14, wherein the subsea electric device has an input conductor connected to a power source, wherein the contactor arrangement is connected to the input conductor to enable the disconnection of the subsea electric device from the power source.

16. The subsea electric device according to claim 14, wherein the conductor section is connected and arranged such that in operation in the closed state, the current through the conductor section has a direction that is substantially opposite to the direction of the current through the movable contact, such that a repelling force is generated between the movable contact and the conductor section, wherein the repelling force increases the contact pressure between the movable contact and the fixed contact.

17. The subsea electric device according to claim 14, wherein the conductor section is connected and arranged such that in operation in the closed state, the current through the conductor section has a direction that is substantially parallel to the direction of the current through the movable contact, such that an attractive force is generated between the movable contact and the conductor section, wherein the attractive force acts on the movable contact to move the movable contact towards the open state.

18. The subsea electric device according to claim 14, wherein the fixed contact comprises a first fixed contact and a second fixed contact, each having a contact portion for contacting a respective contact portion on the movable contact in the closed state, the first fixed contact being connected to the first connection terminal, and the second fixed contact being connected to the conductor section.

19. The subsea electric device according to claim 14, wherein the movable contact comprises at least one contact plate extending in the direction of current flow through the movable contact, the contact plate having contact portions at each end thereof, and the contact portions facing respective contact portions on the fixed contact.

20. The subsea electric device according to claim 14, wherein the conductor section is a metal bar or a metal plate.

* * * * *